US011946714B2

(12) United States Patent
Baumbach

(10) Patent No.: US 11,946,714 B2
(45) Date of Patent: Apr. 2, 2024

(54) BOLT ASSEMBLY WITH CLIP

(71) Applicant: Springfield, Inc., Geneseo, IL (US)

(72) Inventor: Christopher Martin Baumbach, LeClaire, IA (US)

(73) Assignee: Springfield, Inc., Geneseo, IL (US)

( * ) Notice: Subject to any disclaimer, the term of this patent is extended or adjusted under 35 U.S.C. 154(b) by 61 days.

(21) Appl. No.: 17/804,199

(22) Filed: May 26, 2022

(65) Prior Publication Data

US 2022/0390196 A1 Dec. 8, 2022

Related U.S. Application Data

(60) Provisional application No. 63/195,761, filed on Jun. 2, 2021.

(51) Int. Cl.

| | |
|---|---|
| ***F41A 3/18*** | (2006.01) |
| ***F41A 3/22*** | (2006.01) |
| ***F41A 3/72*** | (2006.01) |

(52) U.S. Cl.

CPC ..... *F41A 3/18* (2013.01); *F41A 3/22* (2013.01); *F41A 3/72* (2013.01)

(58) Field of Classification Search

CPC ..... F41A 3/18; F41A 3/20; F41A 3/22; F41A 3/24; F41A 3/72

See application file for complete search history.

(56) References Cited

U.S. PATENT DOCUMENTS

| | | | | |
|---|---|---|---|---|
| 2,085,812 A * | 7/1937 | Loomis | F41A 15/14 42/16 |
| 3,341,963 A | 9/1967 | Seiderman | |
| 3,404,480 A | 10/1968 | Koucky et al. | |
| 3,432,955 A | 3/1969 | Vartanian et al. | |
| 3,631,620 A | 1/1972 | Ohira | |
| 3,816,950 A | 6/1974 | Vesamaa | |
| 4,698,931 A * | 10/1987 | Larsson | F41A 3/22 42/16 |
| 5,606,825 A | 3/1997 | Olsen | |
| 6,000,161 A | 12/1999 | Aalto | |
| 6,418,655 B1 * | 7/2002 | Kay | F41F 1/08 89/185 |

(Continued)

FOREIGN PATENT DOCUMENTS

| | | |
|---|---|---|
| CH | 23833 | 9/1902 |
| CH | 227818 | 7/1943 |

(Continued)

OTHER PUBLICATIONS

English Translation of CH227818 entitled: From Open Position Shutter Shooting Unlatched Automatic Weapon, Especially Machine Gun. Retrieved Jun. 23, 2022.

(Continued)

*Primary Examiner* — Gabriel J. Klein

(74) *Attorney, Agent, or Firm* — Woodard, Emhardt, Henry, Reeves & Wagner, LLP

(57) ABSTRACT

Bolt assemblies for firearms (e.g., bolt action firearms) and methods of assembling and disassembling same are disclosed herein. In particular aspects, bolt assemblies comprising a bolt body, a bolt handle, a bolt shroud, and a clip that secures the bolt shroud to the bolt body are disclosed. The bolt shroud preferably resists removal of the bolt handle from the bolt body.

20 Claims, 14 Drawing Sheets

(56) References Cited

U.S. PATENT DOCUMENTS

| | | | | |
|---|---|---|---|---|
| D610,218 | S | 2/2010 | Barrett | |
| 7,950,177 | B2 | 5/2011 | Laney et al. | |
| D640,766 | S | 6/2011 | Joplin | |
| D670,783 | S | 11/2012 | Barrett | |
| 8,533,986 | B2 * | 9/2013 | Klotz | F41A 3/22 89/1.4 |
| 8,925,230 | B2 | 1/2015 | Warburton et al. | |
| 9,151,553 | B2 | 10/2015 | Constant et al. | |
| D774,619 | S | 12/2016 | Mather | |
| D785,122 | S | 4/2017 | Mather et al. | |
| 9,658,009 | B1 * | 5/2017 | Vankeuren, III | F41A 3/22 |
| 9,885,528 | B2 | 2/2018 | Mather | |
| 10,006,726 | B1 | 6/2018 | Oglesby | |
| D827,753 | S | 9/2018 | Lessard et al. | |
| 10,077,957 | B1 | 9/2018 | Aguf | |
| D854,643 | S | 7/2019 | Schafer et al. | |
| 10,458,731 | B2 | 10/2019 | Mather | |
| D868,196 | S | 11/2019 | Schafer | |
| 10,514,219 | B2 | 12/2019 | Schafer | |
| D891,561 | S | 7/2020 | Parker et al. | |
| 11,624,568 | B2 * | 4/2023 | Ballard | F41A 3/22 42/14 |
| 11,674,762 | B2 * | 6/2023 | Alomaira | F41A 3/72 42/16 |
| 2004/0168362 | A1 | 9/2004 | Aalto et al. | |
| 2010/0257768 | A1 | 10/2010 | Barrett | |
| 2010/0307042 | A1 | 12/2010 | Jarboe et al. | |
| 2011/0232148 | A1 | 9/2011 | Cain et al. | |
| 2012/0137556 | A1 * | 6/2012 | Laney | F41C 23/16 42/6 |
| 2012/0137557 | A1 | 6/2012 | Klotz | |
| 2012/0180360 | A1 | 7/2012 | Jones | |
| 2012/1800360 | | 7/2012 | Jones | |
| 2014/0013641 | A1 * | 1/2014 | Warburton | F41A 3/14 42/16 |
| 2014/0068986 | A1 | 3/2014 | Pietrzyk et al. | |
| 2014/0196343 | A1 | 7/2014 | Wilson et al. | |
| 2015/0233656 | A1 | 8/2015 | Karagias | |
| 2015/0330727 | A1 | 11/2015 | Kolev et al. | |
| 2015/0338186 | A1 | 11/2015 | Hopkins | |
| 2016/0047611 | A1 | 2/2016 | Battaglia et al. | |
| 2016/0202016 | A1 | 7/2016 | Mather et al. | |
| 2016/0252314 | A1 | 9/2016 | Mather et al. | |
| 2017/0010064 | A1 | 1/2017 | Karagias | |
| 2018/0195818 | A1 * | 7/2018 | Schafer | F41A 15/12 |
| 2018/0195823 | A1 | 7/2018 | Schafer et al. | |
| 2018/0202756 | A1 | 7/2018 | Shinkle et al. | |
| 2018/0335266 | A1 | 11/2018 | Cochran et al. | |
| 2019/0078849 | A1 | 3/2019 | Schafer | |
| 2019/0128639 | A1 | 5/2019 | Parker et al. | |
| 2020/0263942 | A1 | 8/2020 | Karaglas | |
| 2021/0381784 | A1 | 12/2021 | Alomaira | |
| 2023/0123825 | A1 * | 4/2023 | Zedrosser | F41A 3/20 42/16 |

FOREIGN PATENT DOCUMENTS

| | | |
|---|---|---|
| DE | 1064389 | 8/1959 |
| DE | 9419743 | 5/1996 |
| DE | 202010015858 | 11/2010 |
| DE | 102010018139 | 10/2011 |
| DE | 202010006040 | 2/2012 |
| GB | 137617 | 1/1920 |
| GB | 778083 | 7/1957 |
| GB | 778083 A * | 7/1957 |

OTHER PUBLICATIONS

English Translation of CH23833 entitled Device for Preventing the Closure at Selbsttaetigen Opening Repeating Rifles With Straight Pull. Retrieved Jun. 23, 2022.

English translation of DE 102010018139 entitled: Locking Pice for Handgun, Comprises Locking Body and Operating Handle Which is Provided With Compressed Inner Part That is Deformed in Recess by Lateral Receiving Opening. Retrieved Jun. 23, 2022.

English translation of DE 1064389 entitled: Assurance for Automatic Weapons. Retrieved Jun. 23, 2022.

English Translation of DE 202010006040 entitled: Closure of a Handgun. Retrieved Jun. 23, 2022.

English translation of DE 202010015858 entitled: Chamber for a Repetitive Rifle. Retrieved Jun. 23, 2022.

English Translation of DE 9419743 entitled: Closure for a Repeating Firearm. Retrieved Jun. 23, 2022.

SIG Cross Bolt Action Video, YouTube, [retrieved onJan. 14, 2021], Retrieved from <https://www.youtube.com/watch?t=356&v=8r36hBmzf3A&feature=youtu.be>.

SIG Cross Operators Manual, Sig Sauer, Retrieved Jan. 4, 2021.

* cited by examiner

BOLT ASSEMBLY WITH CLIP

CROSS REFERENCE TO RELATED APPLICATIONS

The present patent document claims the benefit of the filing date of Provisional U.S. Patent Application No. 63/195,761, filed on Jun. 2, 2021, which is hereby incorporated by reference in its entirety.

BACKGROUND

The present invention pertains generally to firearms and, in particular aspects, to bolt handle arrangements for a firearm.

A bolt-action rifle is a type of firearm that requires the manual operation of a bolt through the use of a bolt handle to load and to extract cartridges from the chamber of the weapon. Bolt-action rifles are dependable, easy to use, and are generally considered to be more accurate than an automatic or semi-automatic weapon. These qualities make a bolt-action rifle a popular firearm despite the decreased rate of fire due to the manual operation.

Many owners desire to customize their firearm to make the firearm more comfortable and easy to use as well as to modify the size and the shape of the firearm. In some instances, this customization may include the bolt handle. For some weapons, the bolt handle is integrally attached to the bolt, making customization difficult by requiring sawing or special tools to remove the bolt handle or requiring modification of the entire bolt assembly. Other firearms allow removal of the bolt handle but require a complicated process for disassembly and reassembly.

Thus, there is a need for improvement in this field.

SUMMARY

In certain aspects, a bolt assembly includes a bolt body including opposing sidewalls and a bolt cavity defined between the opposing sidewalls. A firing pin axis may extend through the bolt cavity. A handle opening may be defined by the bolt body and extends along a direction transverse to the firing pin axis. The bolt assembly may also include a bolt handle including a knob portion and a body portion. The body portion is positioned in the handle opening of the bolt body and a handle aperture is defined through the body portion. A bolt shroud including a bolt shroud tang may be positioned in the bolt cavity and extend at least partially through the handle aperture. A clip may extend transverse to the firing pin axis into the bolt body and the clip contacts the bolt shroud. The bolt shroud tang may resist removal of the body portion of the bolt handle from the handle opening and the clip may resist removal of the bolt shroud tang from the handle aperture of the body portion of the bolt handle. The bolt shroud tang may be removable from the handle aperture when the clip is removed from the bolt shroud and/or bolt body.

In some embodiments, the bolt shroud tang may define a rearward-facing surface that contacts the clip to resist removal of the bolt shroud tang from the handle aperture of the bold handle. The rearward-facing surface may be arranged so that the rearward-facing surface does not contact the bolt handle.

In some embodiments, the clip and the bolt shroud tang may be configured to resist withdrawal of the clip from the bolt shroud tang. In other embodiments, the clip may define a clip aperture having a cross-sectional dimension and the clip may be configured to receive the bolt shroud tang. The bolt shroud tang may include a tang body having a cross-sectional dimension and a tang notch having a cross-sectional dimension each measured orthogonal to the firing pin axis when the bolt shroud tang is inserted into the bolt cavity. The cross-sectional dimension of the tang notch may be smaller than the cross-sectional dimension of the tang body. The tang notch may be positioned within the clip aperture, and the cross-sectional dimension of the clip aperture may be the same or smaller than the cross-sectional dimension of the tang body. The clip may have an end defining an opening to the clip aperture, and the opening to the clip aperture may have a cross-sectional dimension less than that of the clip aperture.

In some embodiments, the clip may be positioned in the handle opening. In further aspects, the clip may positioned within a notch defined by the bolt handle. In other embodiments, the clip includes a clip notch accessible from outside the bolt assembly. The clip notch may be configured to receive a rim of a cartridge and/or the tip of a bullet for use with the bolt assembly to assist with removing the clip from the bolt shroud and/or bolt body.

In another form, a method of assembling a bolt assembly for a firearm may include inserting a bolt handle into a handle opening defined by a bolt body. The bolt body may have a bolt cavity defined between opposing sidewalls and a firing pin axis extending through the bolt cavity. A portion of a bolt shroud is inserted into the bolt cavity and through an aperture defined by a portion of the bolt handle positioned within the bolt cavity. A clip may be inserted into the bolt cavity. The clip may resist removal of the bolt shroud from the bolt cavity, and the bolt shroud may resist removal of the bolt handle from the handle opening of the bolt body.

In some embodiments, the clip may resist removal of the bolt shroud from the bolt cavity by a forward facing surface of the clip contacting a rearward facing surface of the bolt shroud The rearward facing surface of the bolt shroud does not contact the bolt handle. When inserting the bolt handle into the handle opening, a distal end of the bolt handle may pass through a first sidewall of the opposing sidewalls, through the bolt cavity, and into a second sidewall of the opposing sidewalls. Further, the clip defines a clip aperture that receives the bolt shroud.

In some embodiments, the clip and the bolt shroud may be configured to resist withdrawal of the clip from the bolt shroud. The bolt shroud may include a bolt shroud tang. The bolt shroud tang may include a tang body having a cross-sectional dimension and a tang notch having a cross-sectional dimension each measured transverse to the firing pin axis when the bolt shroud tang is inserted into the bolt cavity. The cross-sectional dimension of the tang notch may be less than the cross-sectional dimension of the tang body. In some aspects, inserting a portion of the bolt shroud into the bolt cavity includes aligning the tang notch with the handle opening. In other aspects, the tang notch may be positioned in the clip aperture after inserting the clip into the bolt cavity. Additionally, inserting the clip may include inserting the clip into the handle opening.

Further forms, objects, features, aspects, benefits, advantages, and embodiments of the present invention will become apparent from a detailed description and drawings provided herewith.

DESCRIPTION OF THE SELECTED EMBODIMENTS

Figure 1:
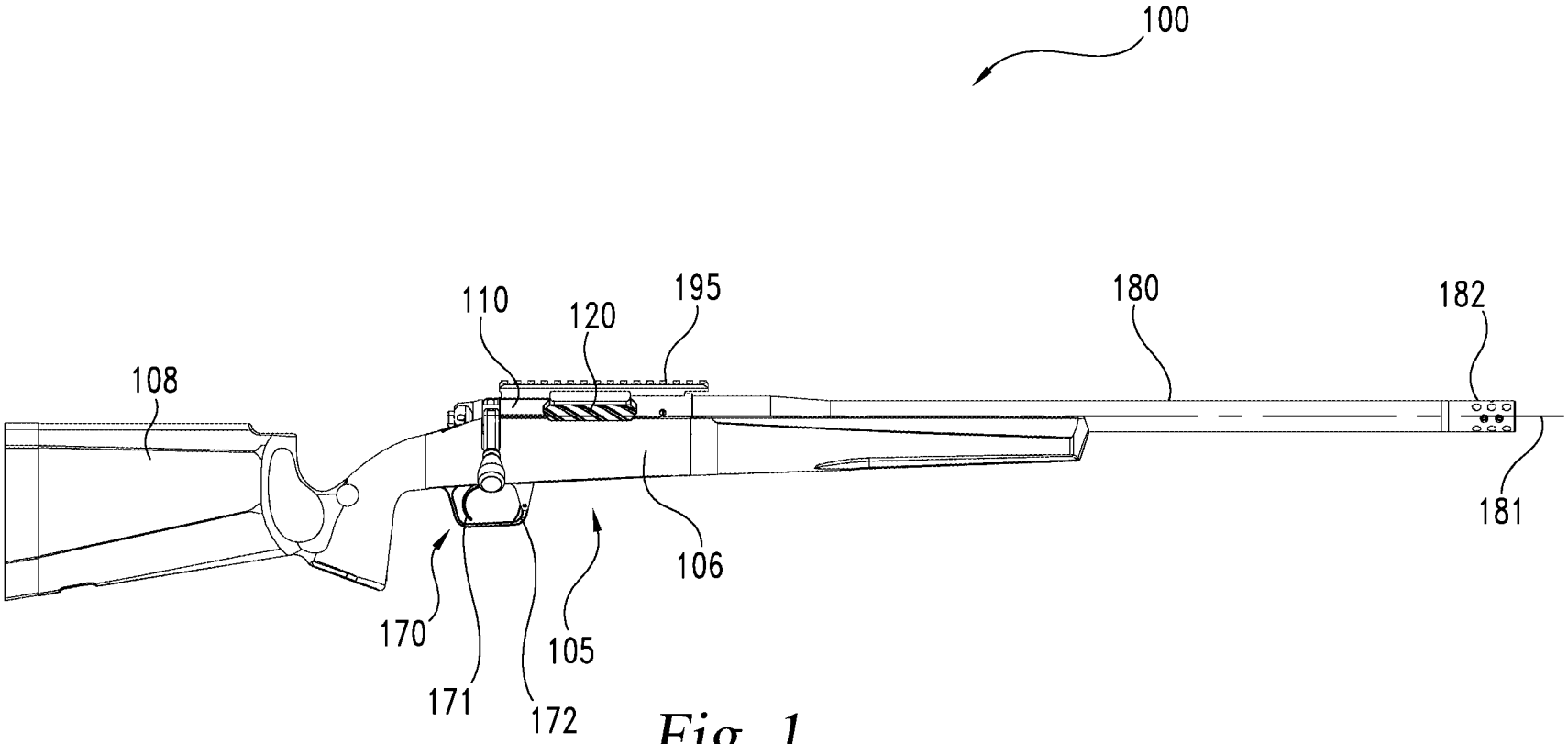
FIG. 1 is a side view of a firearm with a bolt assembly in a locked configuration.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. One embodiment of the invention is shown in great detail, although it will be apparent to those skilled in the relevant art that some features that are not relevant to the present invention may not be shown for the sake of clarity.

Directional terms, such as forward, rearward, top, bottom, etc., may be used in this description with reference to the specific embodiment shown and used for purposes of clarity. It should be recognized that these terms are not meant to be limiting.

FIG. 1 illustrates a firearm 100. In the embodiment shown, the firearm 100 is a rifle and more particularly a bolt-action rifle. Firearm 100 includes a stock assembly 105 that includes a body 106 and a buttstock 108 that extends rearward therefrom. The buttstock 108 may be integrally formed with the body or may be formed separately and attached thereto. A receiver 110 is positioned within the body 106 of the stock assembly 105. A bolt assembly 120 is housed within the receiver 110, and a bolt handle 130 of the bolt assembly 120 extends outside of the receiver 110 to allow manual operation (e.g., reciprocation) of the bolt assembly 120.

Firearm 100 includes a trigger assembly 170 having a trigger 171 that projects from the underside of the body 106. A trigger guard 172 surrounds the trigger 171 to resist inadvertent actuation of the trigger 171. Trigger assembly 170 may be included as a portion of receiver 110.

A barrel 180 is affixed to and extends forward from the receiver 110. The barrel 180 includes a rifled bore 184 and defines a barrel axis 181 extending longitudinally therethrough. The barrel 180 may be supported by the body 106 of the stock assembly 105. In some instances, the barrel 180 is "free floating" and does not contact a forward portion of the stock assembly 105. In some embodiments, a muzzle brake 182 may be positioned at the forward end of the barrel 180. The muzzle brake 182 may be used to redirect propellant gases created during firing of the firearm 100 to counteract recoil and/or muzzle rise.

An accessory rail 195 may be attached to the receiver 110 above the bolt assembly 120 to provide a location to attach any desired accessories, such as a scope, to the firearm 100. In the embodiment shown, the accessory rail 195 takes the form of a Picatinny rail; however, any variety of rail interface system suitable for attaching accessories to a firearm may be used.

Figure 2A:
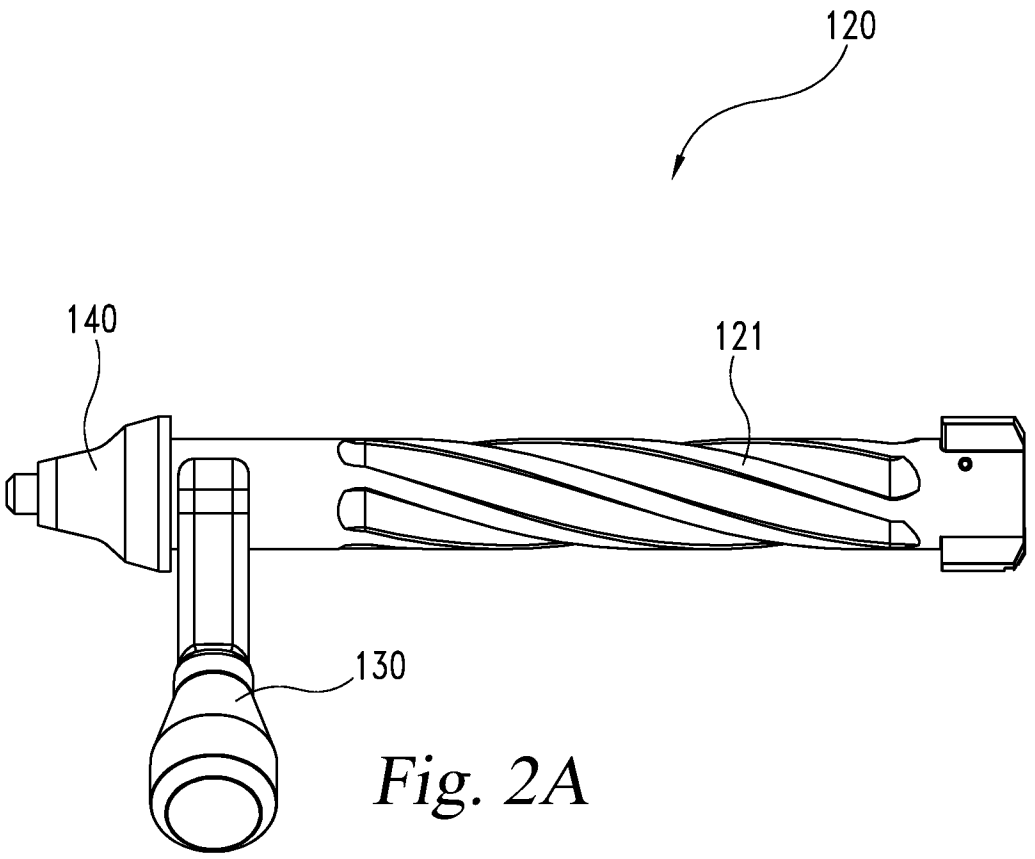
FIG. 2*a* is a top view of a bolt assembly of the firearm of FIG. 1 with the bolt in the unlocked configuration.
Figure 2B:
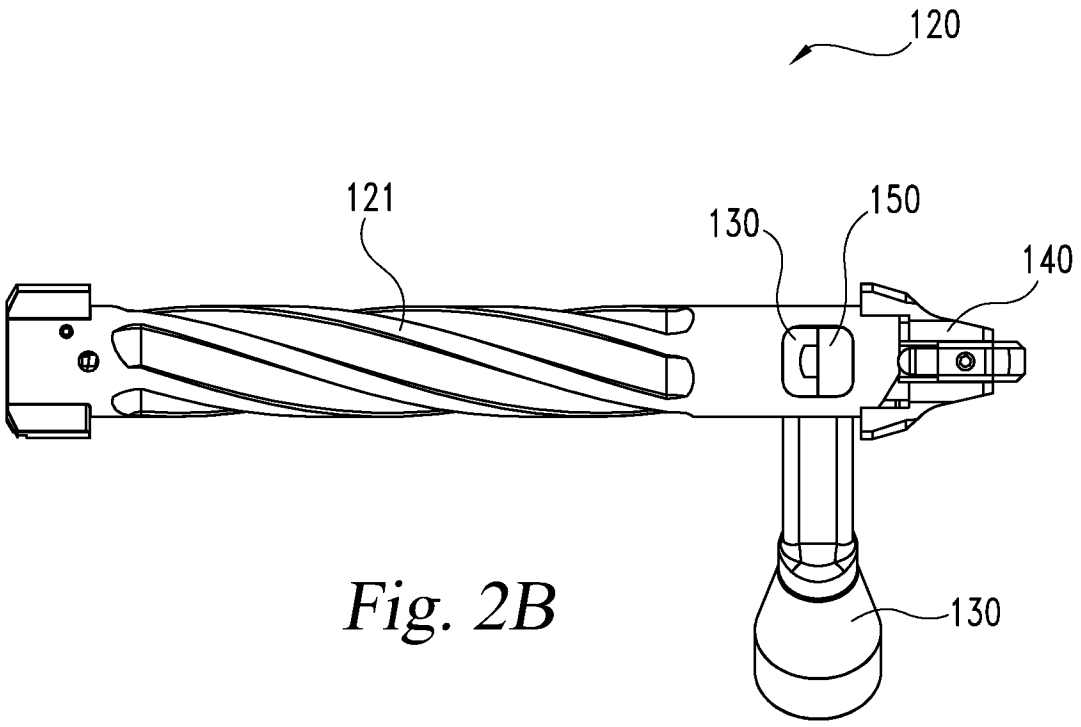
FIG. 2*b* is a bottom view of a bolt assembly of the firearm of FIG. 2*a*.

The bolt assembly 120 of firearm 100 is illustrated in FIGS. 2*a* and 2*b*. The bolt assembly 120 includes a bolt body 121. The bolt body 121 has a forward end that is positioned near the barrel 180 and a rearward end nearer to the buttstock 108 when the bolt assembly 120 is assembled in the firearm. A bolt handle 130 is coupled to the bolt body 121 near the rearward end of the bolt body 121. A bolt shroud 140 is coupled to the bolt body 121 and positioned rearward of the bolt handle 130 at the rearward end of the bolt body 121. As shown in FIG. 2*b*, a clip 150 is positioned adjacent to the bolt handle 130 when the bolt assembly 120 is in an assembled configuration.

Figure 3:
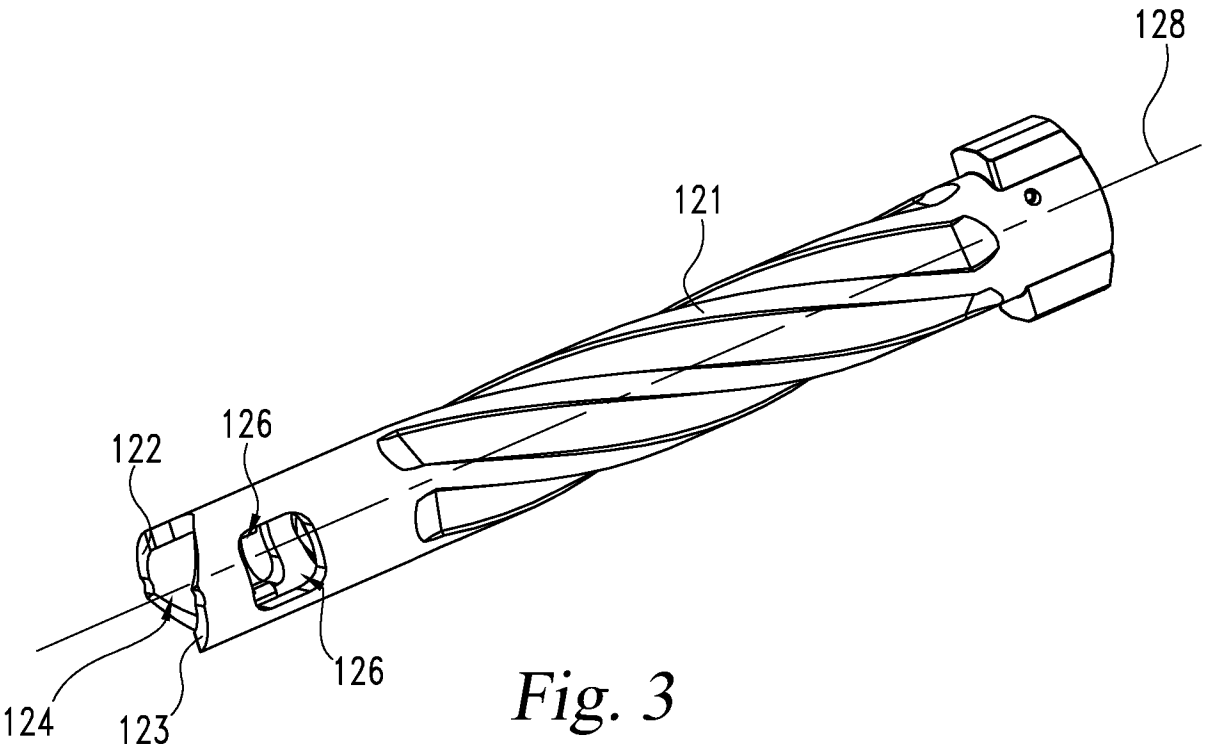
FIG. 3 is a perspective view of a bolt body of the bolt assembly of FIG. 2*a*.

A perspective view of the bolt body 121 is shown in FIG. 3. The bolt body 121 includes opposing sidewalls 122, 123. Outer surfaces of the opposing sidewalls 122, 123 define an outer perimeter of the bolt body 121. A bolt cavity 124 is defined between inner surfaces of the opposing sidewalls 122, 123. A handle opening 126 is defined by the sidewalls 122, 123 of bolt body 121. The handle opening 126 is arranged to receive a portion of the bolt handle 130 extending transversely through the bolt body 121. A bolt axis 128 runs longitudinally through the center of the bolt body 121. In most embodiments, the bolt axis 128 is coaxial with a firing pin axis and/or the barrel axis 181 when the bolt assembly 120 is positioned in the firearm 100. Although the bolt body 121 shown in FIG. 3 has a cylindrical shape, in other embodiments, the bolt body may be any other suitable shape.

Figure 4A:
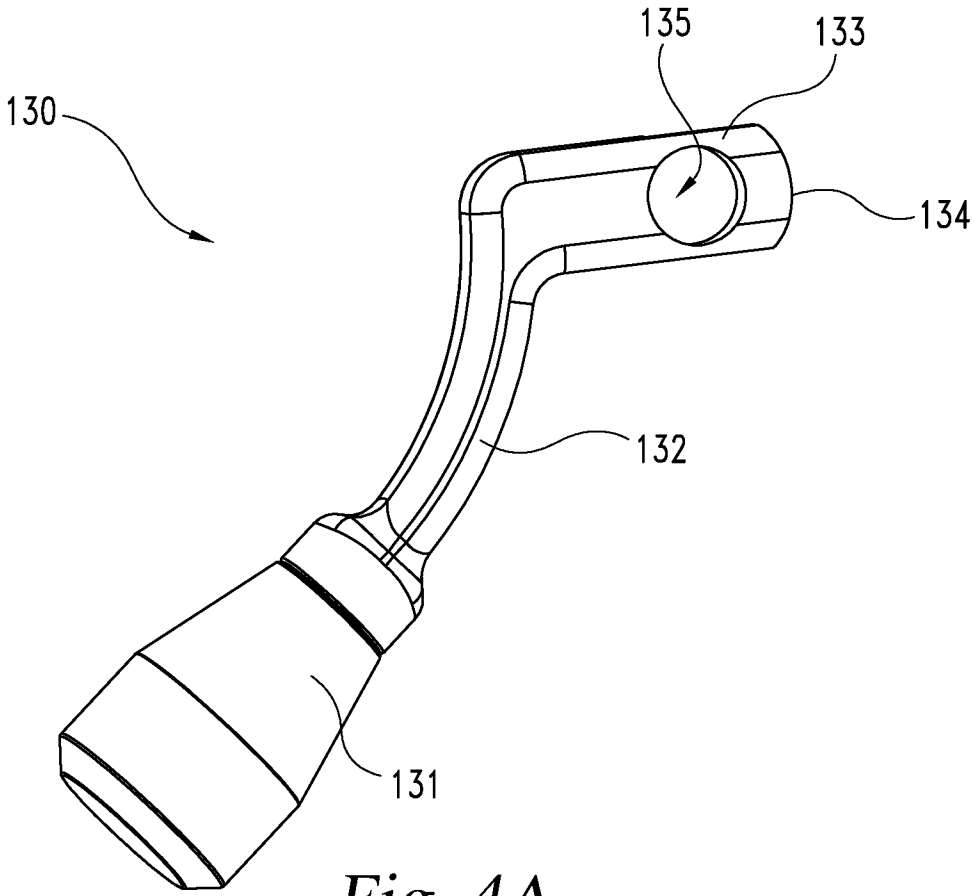
FIG. 4*a* is a front perspective view of a bolt handle of the bolt assembly of FIG. 2*a*.
Figure 4B:
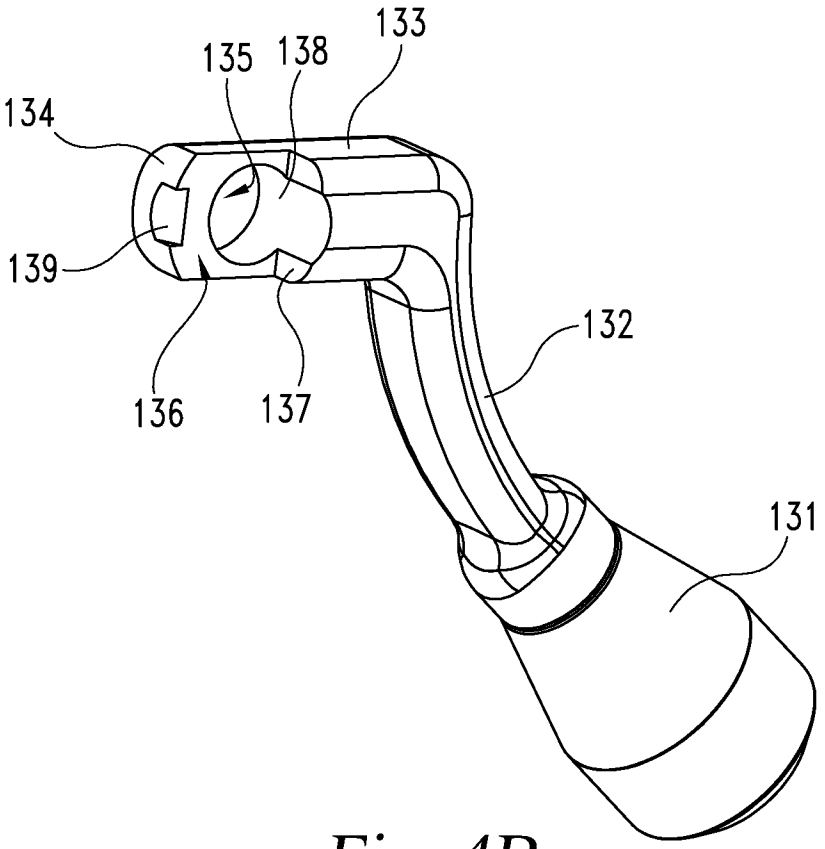
FIG. 4*b* is a rear perspective view of the bolt handle of FIG. 4*a*.

The bolt handle 130 is shown in FIGS. 4*a* and 4*b*. Bolt handle 130 includes a knob portion 131, an intermediate portion 132, and a body portion 133. The intermediate portion 132 is positioned intermediate the knob portion 131 and the body portion 133. The body portion 133 includes a distal end 134 opposite the intermediate portion 132. The body portion 133 is sized and configured for receipt in the handle opening 126 defined by the bolt body 121. The body portion 133 defines a handle aperture 135.

As shown in FIG. 4*b*, the body portion 133 defines a cutout portion 136. Cutout portion 136 extends from the distal end 134 of the body portion 133 to a cutout surface 137 defined on body portion 133. As shown in FIG. 4*b*, cutout surface 137 may include a curved portion 138 that corresponds to handle aperture 135. Cutout surface 137 is positioned at a length along body portion 133 approximately equal to or shy of the position of the side of handle aperture 135 that is closest to the intermediate portion 132. In the embodiment shown, the cutout portion 136 extends through about half of the width of body portion 133. Additionally, a handle notch 139 may be defined through a portion of the distal end 134 of the body portion 133.

Figure 5A:
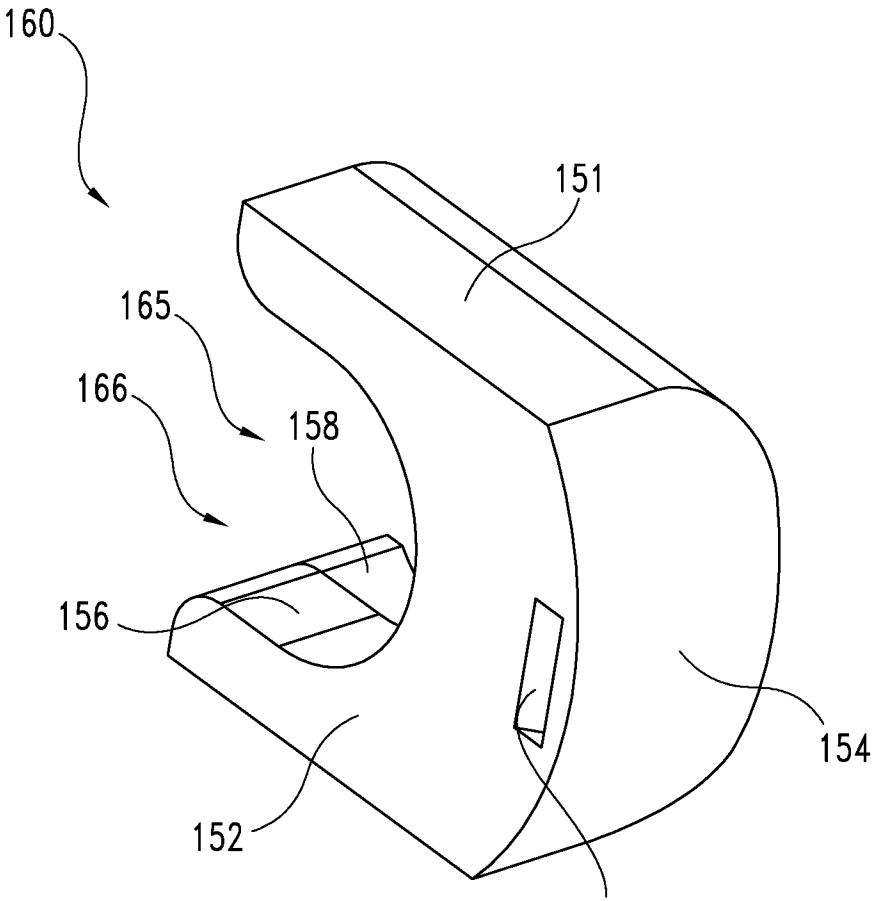
FIG. 5*a* is a front perspective view of a clip of the bolt assembly of FIG. 2*a*.
Figure 5B:
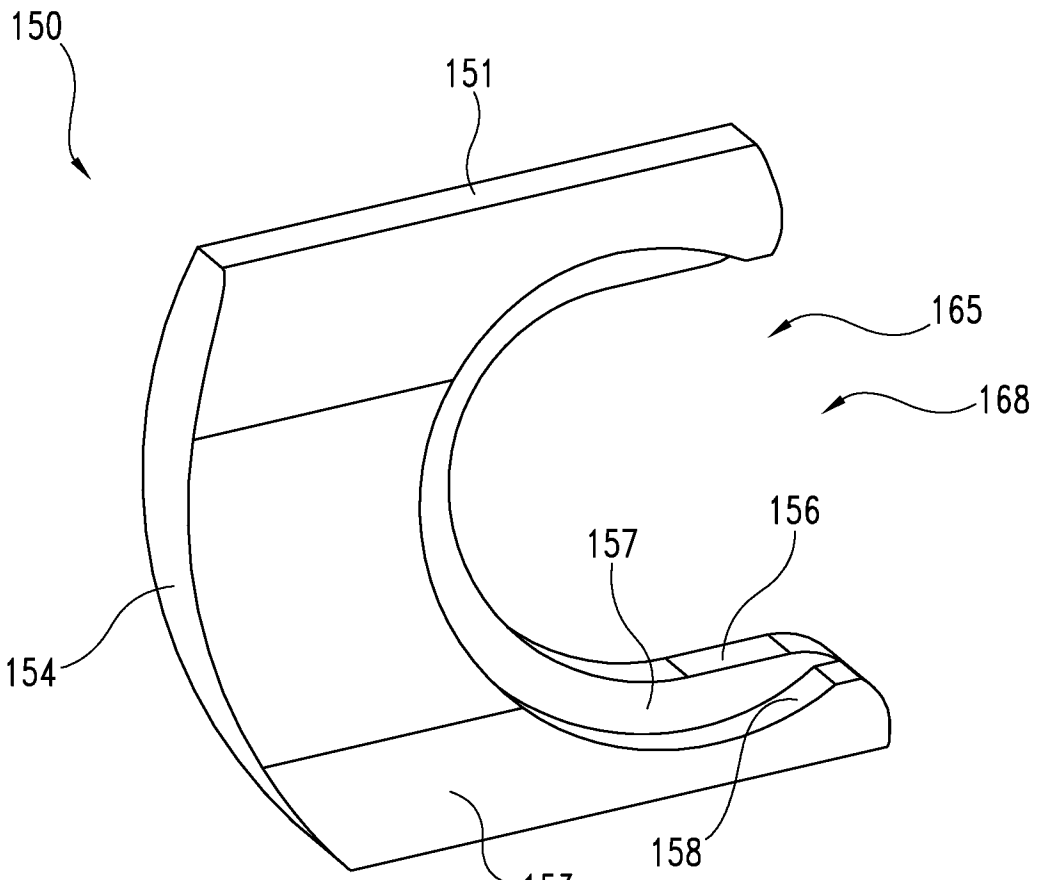
FIG. 5*b* is a rear perspective view of a clip of the bolt assembly of FIG. 2*a*.

A front perspective view of clip 150 is illustrated in FIG. 5*a* and a rear perspective view of clip 150 is shown in FIG. 5*b*. Clip 150 includes a clip body 151. The clip body 151 includes a front surface 152 and a rear surface 153 (see FIG. 5*b*) and a clip distal end 154. A clip notch 159 is defined through a portion of the clip body 151 near the clip distal end 154.

A clip aperture 165 is defined through clip body 153. The clip aperture includes a first portion 166 and a second portion 168. The first portion 166 of the clip aperture 165 is surrounded by a first clip aperture surface 156. The second portion 168 of the clip aperture 165 is surrounded by a second clip aperture surface 158. The first portion 166 of the clip aperture 165 has a smaller cross-sectional dimension (e.g., diameter) than the second portion 168. For example, as measured in a direction orthogonal to the firing pin axis and/or bolt axis 128 and orthogonal to the direction of insertion of the bolt handle 130 through the handle opening 126, the dimension of the first portion 166 may be smaller than the second portion 168. The second portion 168 may have a cross-sectional dimension equal to that of the handle aperture 135.

As shown in FIG. 5*b*, the first clip aperture surface 156 is positioned inward of the second portion 168 relative to the clip body 153 to create the first portion 166 of the clip aperture 165 with a smaller cross-sectional dimension when compared to the second clip aperture surface 158, which is sized to create the second portion 168 of the clip aperture with a larger cross-sectional dimension. The inward positioning of the first clip aperture surface 156 creates a rear seat 157 that is adjacent to the front of second clip aperture surface 158.

Figure 6:
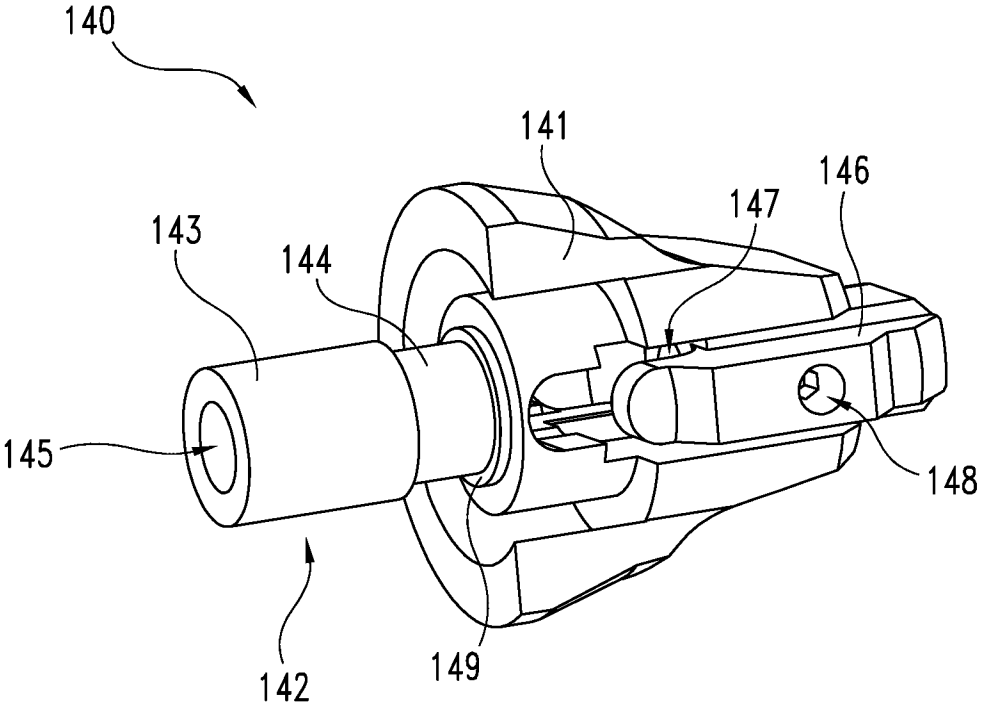
FIG. 6 is a perspective view of a bolt shroud of the bolt assembly of FIG. 2*a*.

As shown in FIG. 6 the bolt shroud 140 includes a bolt shroud body 141. A bolt shroud tang 142 extends from the bolt shroud body 141. The bolt shroud tang 142 has a segment with a first cross-sectional dimension and a second cross-sectional dimension. For example, bolt shroud tang 142 may include a tang body 143, a tang notch 144, and a rear tang surface 149. The tang notch 144 has a smaller cross-sectional dimension (e.g., diameter) than the tang body 143.

The first cross-sectional dimension (e.g., the cross-sectional dimension of the tang body 143, such as its diameter) is substantially the same as or smaller than the cross-sectional dimension (e.g., diameter) of the handle aperture 135 of the bolt handle 130 so that the first cross-sectional dimension of the bolt shroud tang 142 can pass at least partially through the handle aperture 135. Additionally, the first cross-sectional dimension of the bolt shroud tang 142 is preferably larger than the cross-sectional dimension (e.g., diameter) of the first portion 166 of the clip aperture 165 of the clip 150. Advantageously, this can resist movement of the first cross-sectional dimension of the tang body 143 through the first portion 166 of the clip aperture 165 when the clip 150 is inserted into the handle opening adjacent to the body portion 133 of the bolt handle 130.

The second cross-sectional dimension (e.g., the cross-sectional dimension of the tang notch 144, such as its diameter) is preferably substantially the same as, or smaller than, the cross-sectional dimension (e.g., diameter) of the first portion 166 of the clip aperture 165 of the clip 160. This allows the first clip aperture surface 156 to fit around the tang notch 144 of the bolt shroud 140 when the clip 150 is inserted into the handle opening 126 and the tang notch 144 is aligned with the first portion 166 of the clip 150.

A bolt shroud cavity 145 may be defined by the bolt shroud tang 142 and the bolt shroud body 141. A shroud cap 146 may be positioned within a slot defined by the bolt shroud body 141 that is in communication with the bolt shroud cavity. The shroud cap 146 can have a shroud cap aperture 147 configured to receive a rearward end of a firing pin 174 (see FIG. 7) that is part of the bolt assembly 120. An attachment opening 148 defined by the shroud cap 146 may receive an attachment mechanism, such as a screw, for attaching the firing pin 174 to the shroud cap 146.

Figure 7:
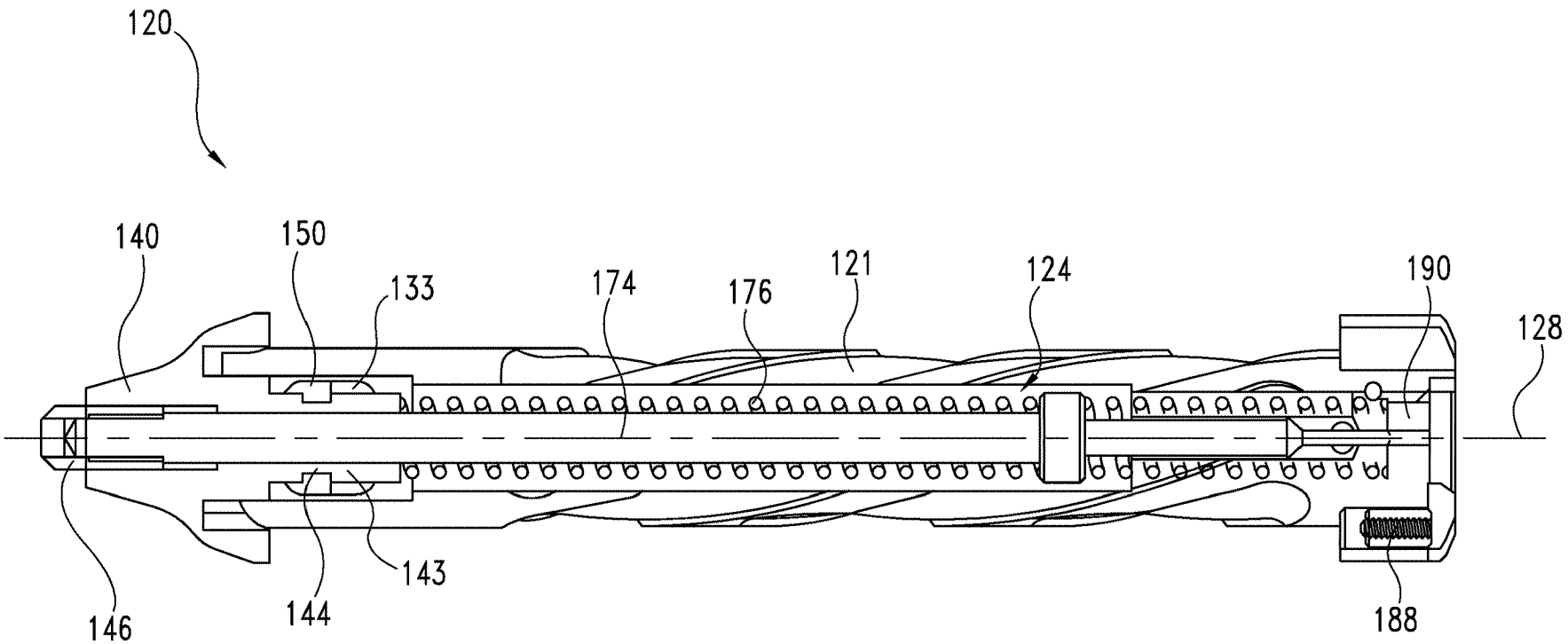
FIG. 7 is a cross-sectional side view of the bolt assembly of FIG. 2*a*.

A cross-sectional view of the bolt assembly 120 with the clip 150 inserted through handle opening 126 is illustrated in FIG. 7. As shown, the bolt body 121 surrounds a firing pin 174. The firing pin 174 fits concentrically within a firing pin spring 176. The firing pin 174 is translatable within the bolt body 121 so that the firing pin 174 can extend towards a chamber of the barrel 180 of the firearm 100. The chamber is configured to hold a cartridge having a bullet, a casing, and a primer. The bullet is fired from the cartridge by the firing pin 174 striking the primer and causing propellant (e.g., a powder charge within the cartridge) to ignite. An extractor 188 is located between the bolt assembly 120 and the barrel 180 and operates to remove spent cartridge casings from the chamber after the bullet from the cartridge has been fired. An ejector 190 then ejects the spent casing from the firearm 100.

Figure 8:
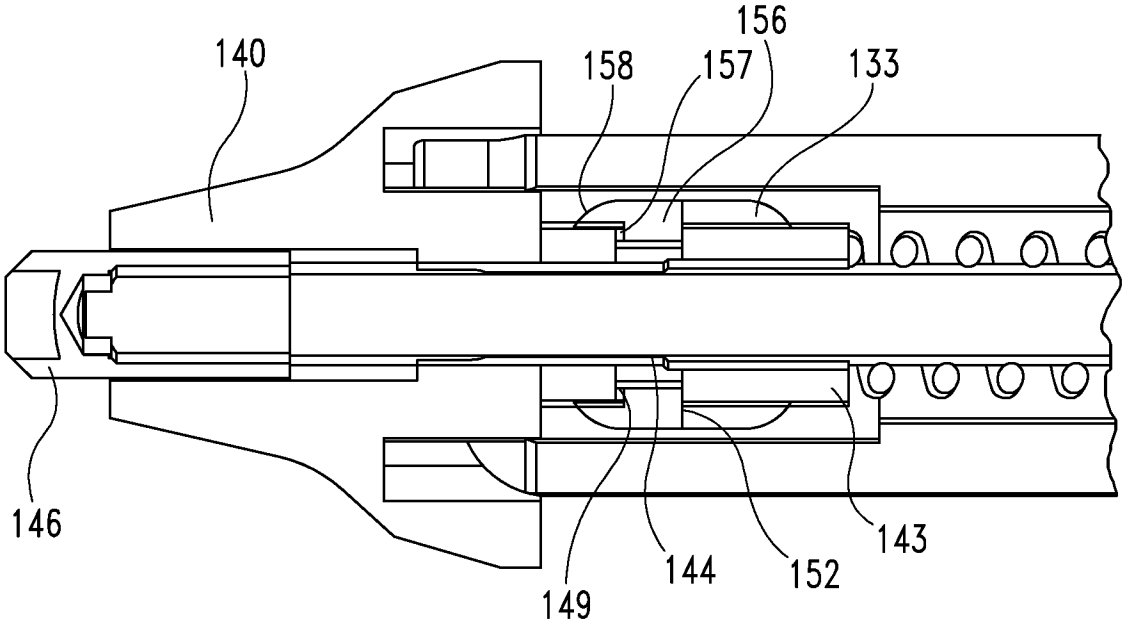
FIG. 8 is a partial cross-sectional side view of the bolt assembly of FIG. 2*a* when a clip is inserted into a handle opening so that the bolt shroud is secured to the bolt body.

A zoomed view of the cross-section of the bolt assembly (see FIG. 8) shows the interaction of the clip 150 with the bolt shroud tang 142 when the clip 150 is inserted into handle opening 126 to hold the bolt shroud 140 in association with the bolt assembly 120. As shown, the tang body 143 is inserted through the handle aperture 135 so that at least a portion of the tang body 143 is surrounded by the body portion 133 of the bolt handle 130. The tang notch 144 of bolt shroud tang 142 is positioned within the first portion 166 of clip aperture 165 so that the first clip aperture surface 156 surrounds at least a portion of the tang notch 144. Because of the reduced cross-sectional dimension of the first portion 166 of the clip aperture 165 compared to the second portion 168 of the clip aperture 165, the handle aperture 135, and/or the first cross-sectional dimension of the tang body 143, the tang body 143 is unable to be removed from the bolt assembly 120 when the clip 150 is in position in the bolt assembly 120. As will be appreciated, the cross-sectional dimension of the tang body 143 is larger than the cross-sectional dimension of the first portion 166 of the clip aperture 165, so that the clip 150 prevents rearward movement and removal of the bolt shroud 140 as the tang body 143 contacts the front surface 152 of the clip 150.

Figure 9:
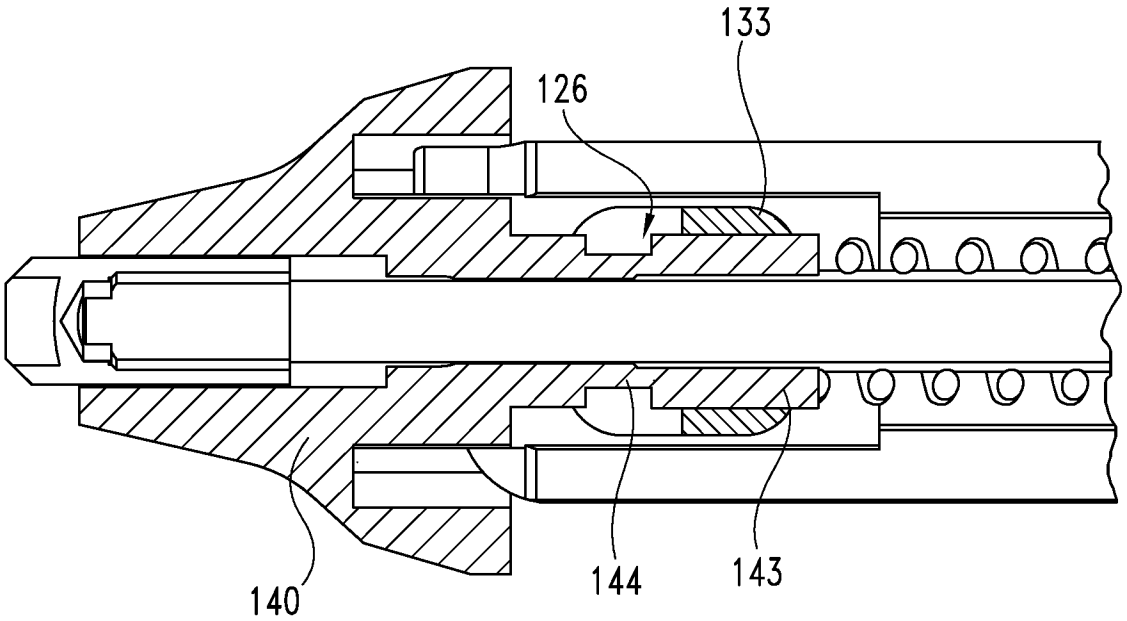
FIG. 9 is a partial cross-sectional side view of the bolt assembly of FIG. 2*a* when the clip is removed from the handle opening so that the bolt shroud can move rearward relative to the bolt body and can be separated from the bolt body.

FIG. 9 shows a zoomed view of the cross-section of the bolt assembly 120 with the clip 150 removed from handle opening 126 and its position adjacent to the body portion 133 of the bolt handle 130 when the bolt handle 130 is inserted through handle opening 126. As illustrated in FIG. 9, the bolt shroud 140 is capable of moving rearwardly from and/or forwardly into its position in the configuration shown in FIG. 8. In other words, without the clip 150 the bolt shroud 140 may be either inserted into the bolt cavity 124 of the bolt body 121 or removed from the bolt cavity 124. In the unlocked configuration, the clip 150 is removed.

Removal of clip 150 provides clearance for the bolt shroud to move axially within the bolt cavity 124 along the bolt axis 128, as the first clip aperture surface 156 is no longer positioned to impede movement of the bolt shroud 140. For insertion of the bolt shroud into the bolt cavity 124, omission of the clip 150 allows tang body 143 of the bolt shroud tang 142 to move forward through the handle aperture 135 defined through body portion 133 of the bolt handle 130. For removal of the bolt shroud 140, removal of the clip 150 allows the tang body 143 to move rearwardly along bolt axis 128 without being inhibited by the front surface 152 of the clip 150.

Figure 10:
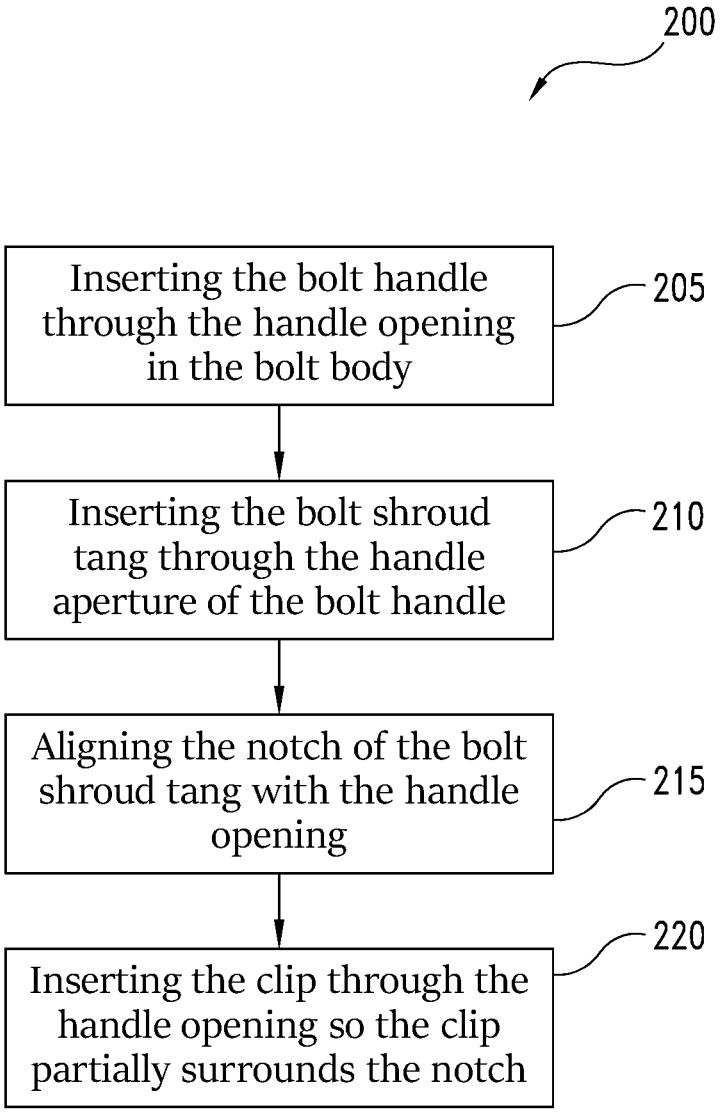
FIG. 10 is a flowchart illustrating a method of assembling the bolt assembly of FIG. 2*a*.

A method of assembling the bolt handle is shown in flowchart 200 illustrated in FIG. 10. In a first stage 205, the bolt handle 130, and more specifically, the body portion 133 of bolt handle 130, is inserted through the handle opening 126 of the bolt body 121. In some embodiments, the bolt handle 130 is inserted through the handle opening 126 until the distal end 134 of the bolt handle 130 is flush with or within an outer perimeter of the bolt body. To insert the bolt handle 130, a force that is transverse to the direction of the bolt axis 128 is applied to the bolt handle 130 to insert the body portion 133 of the bolt handle 130 through the handle opening 126. The bolt handle 130 may be inserted through the handle opening 126 so that the handle aperture 135 is positioned within the bolt cavity 124.

In some embodiments, a hard stop may be present that limits the bolt handle 130 from being inserted through the handle opening 126 past a certain point. As an example, this hard stop may be designed to stop further insertion of the bolt handle 130 when the bolt handle 130 is positioned so that the handle aperture 135 of the bolt handle 130 is aligned with the bolt axis 128 of the firearm 100. In some embodiments, the hard stop is formed by the curvature between the intermediate portion 132 and the body portion 133 of the bolt handle 130 (see FIGS. 4*a* and 4*b*). In other embodiments, different forms of hard stops may be used to limit insertion of the of the bolt handle 130 into the handle opening 126, such as a tab that extends from the bolt handle 130 or any other suitable method and/or having different outer dimensions and/or shapes of the bolt handle that interfere with the bolt body 121.

In a second stage 210, the bolt shroud 140 is inserted into the bolt cavity 124 so that the bolt shroud tang 142 may be inserted into handle aperture 135 of the bolt handle 130. The firing pin 174 may be attached to the bolt shroud 140, so that the firing pin 174 passes through the handle aperture 135 along the barrel axis 181 of the firearm 100.

In a third stage 215, the tang notch 144 of the bolt shroud tang 142 is aligned with the portion of the handle opening 126 that is not filled by the body portion 133 of bolt handle 130 due to cutout portion 136 of body portion 133. In some embodiments, the third stage 215 is performed in conjunction with the second stage 210, as the bolt shroud 140 may be initially inserted into bolt cavity 124 to the position where the tang notch 144 is aligned with the cutout portion 136 and the handle opening 126.

In a fourth stage 220, the clip 150 is inserted through the handle opening 126 so that the clip 150 has a portion at least partially within the tang notch 144 of the bolt shroud tang 142. In some embodiments, the clip 150 is inserted so that the tang notch 144 fits through the first portion 166 of the clip aperture 165, and the tang notch 144 is partially surrounded by the first clip aperture surface 156 (see FIG. 7). The clip 150 prevents bolt shroud tang 142 from being removed from bolt cavity 124 as the first portion 166 of the clip aperture 165 has a cross-sectional dimension that is smaller than the cross-sectional dimension of the tang body 143, preventing rearward movement of the bolt shroud tang 142.

Figure 11:
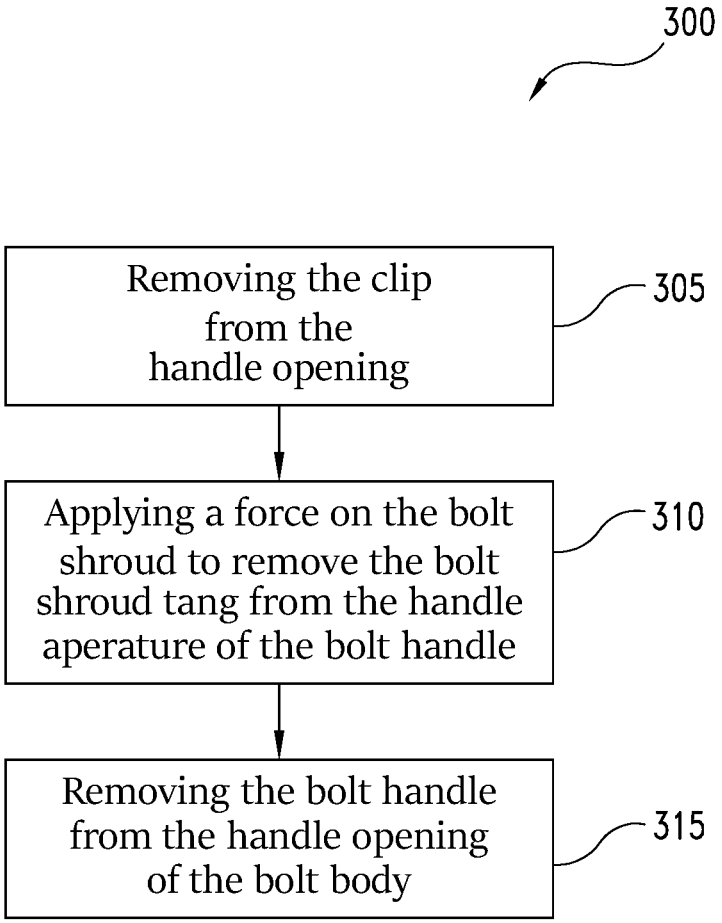
FIG. 11 is a flowchart illustrating a method of disassembling the bolt assembly of FIG. 2*a*.

A method of disassembling the bolt handle is shown in flowchart 300 illustrated in FIG. 11. In a first stage 305, the clip 150 is removed from handle opening 126 and its position within the cutout portion 136 defined in the body portion 133 of the bolt handle 130. In some embodiments, the handle notch 139 and the clip notch 159 may be used to assist with removal of the clip 150 from the handle opening 126. The handle notch 139 provides access to the clip notch 159, which may act as a grip point for removal of the clip 150. In some embodiments, a user may remove the clip 150 without a tool, but in other embodiments a tool such as a screwdriver, tweezers, or a bullet may be used to remove clip 150.

In some embodiments, removing the clip 150 from the handle opening 126 removes the first clip aperture surface 156 from the tang notch 144 of the bolt shroud tang 142. Without the clip 150 having a portion in the tang notch, the bolt shroud tang 142 is allowed to translate within the bolt cavity 124 along the bolt axis 128. As shown in FIG. 9, the body portion 133 of bolt handle 130 does not impede movement of the bolt shroud tang 142.

In a second stage 310, the bolt shroud 140 is removed from the handle aperture 135 of the bolt handle 130. In some embodiments, a force applied to the bolt shroud 140 is applied in a direction that is parallel to the bolt axis 128. As an example, the force applied to the bolt shroud 140 may be a rearward force that allows removal of the bolt shroud tang 142 from the bolt cavity 124 through the handle aperture 135 of the bolt handle 130.

In a third stage 315, the body portion 133 of the bolt handle 130 is removed from the handle opening 126 defined through the bolt body 121. When the bolt shroud tang 142 is inserted through the handle aperture 135, the bolt shroud tang 142 prevents removal of bolt handle 130 from the handle opening 126. However, after the bolt shroud tang 142 is removed from the handle aperture 135, there is clearance for the bolt handle 130 to be removed from handle opening 126. In some embodiments, the force applied to the bolt handle 130 to remove the bolt handle 130 from the handle opening 126 is applied in a transverse direction with respect to the bolt axis 128.

The following numbered clauses set out specific embodiments that may be useful in understanding the present invention:

1. A bolt assembly comprising:
   - a bolt body including opposing sidewalls and a bolt cavity defined between said opposing sidewalls with a firing pin axis extending through said bolt cavity, wherein a handle opening is defined by said bolt body and extends along a direction transverse to said firing pin axis;
   - a bolt handle including a knob portion and a body portion, wherein said body portion is positioned in said handle opening of said bolt body, wherein a handle aperture is defined through said body portion;
   - a bolt shroud including a bolt shroud tang positioned in said bolt cavity and extending at least partially through the handle aperture; and
   - a clip extending transverse to said firing pin axis into said bolt body, wherein said clip contacts said bolt shroud;
   - wherein said bolt shroud tang resists removal of the body portion of the bolt handle from the handle opening;
   - wherein said clip resists removal of the bolt shroud tang from the handle aperture of the body portion of the bolt handle; and wherein said bolt shroud tang is removable from the handle aperture when said clip is removed from the bolt shroud and/or bolt body.

2. The bolt assembly of clause 1, wherein said bolt shroud tang defines a rearward-facing surface that contacts said clip to resist removal of the bolt shroud tang from the handle aperture of the bold handle.
3. The bolt assembly of clause 2, where said rearward-facing surface does not contact the bolt handle.
4. The bolt assembly of any one of clauses 1-3, wherein said clip and said bolt shroud tang are configured to resist withdrawal of the clip from the bolt shroud tang.
5. The bolt assembly of any one of clauses 1-4, wherein said clip defines a clip aperture having a cross-sectional dimension and configured to receive the bolt shroud tang.
6. The bolt assembly of clause 5, wherein said bolt shroud tang includes a tang body having a cross-sectional dimension and a tang notch having a cross-sectional dimension each measured orthogonal to the firing pin axis when the bolt shroud tang is inserted into the bolt cavity;

wherein the cross-sectional dimension of said tang notch is smaller than said cross-sectional dimension of said tang body;

wherein the tang notch is positioned within said clip aperture; and wherein the cross-sectional dimension of the clip aperture is the same or smaller than the cross-sectional dimension of said tang body.

7. The bolt assembly of clause 6, wherein the clip has an end defining an opening to said clip aperture; and wherein the opening to said clip aperture has a cross-sectional dimension less than that of said clip aperture.
8. The bolt assembly of any one of clauses 1-7, wherein the clip is positioned in said handle opening.
9. The bolt assembly of clause 8, wherein the clip is positioned within a notch defined by the bolt handle.
10. The bolt assembly of any one of clauses 1-9, wherein said clip includes a clip notch accessible from outside the bolt assembly, wherein said clip notch is configured to receive a rim of a cartridge and/or the tip of a bullet for use with the bolt assembly to assist with removing the clip from said bolt shroud and/or bolt body.
11. A method of assembling a bolt assembly for a firearm, comprising:

inserting a bolt handle into a handle opening defined by a bolt body, the bolt body having a bolt cavity defined between opposing sidewalls and a firing pin axis extending through said bolt cavity;

inserting a portion of a bolt shroud into said bolt cavity and through an aperture defined by a portion of said bolt handle positioned within said bolt cavity; and inserting a clip into said bolt cavity;

wherein said clip resists removal of the bolt shroud from the bolt cavity; and wherein said bolt shroud resists removal of the bolt handle from the handle opening of the bolt body.

12. The method of clause 11, wherein said clip resists removal of the bolt shroud from the bolt cavity by a forward facing surface of said clip contacting a rearward facing surface of the bolt shroud.
13. The method of clause 12, wherein the rearward facing surface of the bolt shroud does not contact the bolt handle.
14. The method of any one of clauses 11-13, wherein when inserting the bolt handle into the handle opening a distal end of the bolt handle passes through a first sidewall of said opposing sidewalls, through said bolt cavity, and into a second sidewall of said opposing sidewalls.
15. The method of any one of clauses 11-14, wherein said clip defines a clip aperture that receives said bolt shroud.
16. The method of any one of clauses 11-15, wherein said clip and said bolt shroud are configured to resist withdrawal of the clip from the bolt shroud.
17. The method of clause 16, wherein said bolt shroud includes a bolt shroud tang, wherein said bolt shroud tang includes a tang body having a cross-sectional dimension and a tang notch having a cross-sectional dimension each measured transverse to the firing pin axis when the bolt shroud tang is inserted into the bolt cavity, and wherein the cross-sectional dimension of said tang notch is less than said cross-sectional dimension of said tang body.
18. The method of clause 17, wherein said inserting a portion of said bolt shroud into said bolt cavity includes aligning said tang notch with said handle opening.
19. The method of any one of clauses 17-18, wherein the tang notch is positioned in the clip aperture after inserting said clip into the bolt cavity.
20. The method of any one of clauses 17-19, wherein inserting the clip includes inserting the clip into the handle opening.

While the invention has been illustrated and described in detail in the drawings and foregoing description, the same is to be considered as illustrative and not restrictive in character, it being understood that only the preferred embodiment has been shown and described and that all changes, equivalents, and modifications that come within the spirit of the inventions defined by following claims are desired to be protected. All publications, patents, and patent applications cited in this specification are herein incorporated by reference as if each individual publication, patent, or patent application were specifically and individually indicated to be incorporated by reference and set forth in its entirety herein.

The invention claimed is:

1. A bolt assembly comprising:

a bolt body including opposing sidewalls and a bolt cavity defined between said opposing sidewalls with a firing pin axis extending through said bolt cavity, wherein a handle opening is defined by said bolt body and extends along a direction transverse to said firing pin axis;

a bolt handle including a knob portion and a body portion, wherein said body portion is positioned in said handle opening of said bolt body, wherein a handle aperture is defined through said body portion;

a bolt shroud including a bolt shroud tang positioned in said bolt cavity and extending at least partially through the handle aperture; and a clip extending, transverse to said firing pin axis into said bolt body, wherein said clip defines a clip aperture having a cross-sectional dimension and wherein said clip aperture is configured to receive said bolt shroud, and wherein said clip contacts said bolt shroud;

wherein said clip resists removal of the bolt shroud tang from the handle aperture of the body portion of the bolt handle; and wherein said bolt shroud tang is removable from the handle aperture when said clip is removed from the bolt shroud and/or bolt body.

2. The bolt assembly of claim 1, wherein said bolt shroud tang defines a rearward-facing surface that contacts said clip to resist removal of the bolt shroud tang from the handle aperture of the bold handle.

3. The bolt assembly of claim 2, where said rearward-facing surface does not contact the bolt handle.

4. The bolt assembly of claim 1, wherein said clip and said bolt shroud tang are configured to resist withdrawal of the clip from the bolt shroud tang.

5. The bolt assembly of claim 1, wherein said bolt shroud tang includes a tang body having a cross-sectional dimension and a tang notch having a cross-sectional dimension each measured orthogonal to the firing pin axis when the bolt shroud tang is inserted into the bolt cavity;

wherein the cross-sectional dimension of said tang notch is smaller than said cross-sectional dimension of said tang body;

wherein the tang notch is positioned within said clip aperture; and wherein the cross-sectional dimension of the clip aperture is the same or smaller than the cross-sectional dimension of said tang body.

6. The bolt assembly of claim 5, wherein the clip has an end defining an opening to said clip aperture; and wherein the opening to said clip aperture has a cross-sectional dimension less than that of said clip aperture.

7. The bolt assembly of claim 1, wherein the clip is positioned in said handle opening.

8. The bolt assembly of claim 7, wherein the clip is positioned within a notch defined by the bolt handle.

9. The bolt assembly of claim 1, wherein said clip includes a clip notch accessible from outside the bolt assembly, wherein said clip notch is configured to receive a rim of a cartridge and/or the tip of a bullet for use with the bolt assembly to assist with removing the clip from said bolt shroud and/or bolt body.

10. The bolt assembly of claim 1, wherein said bolt shroud tang resists removal of the body portion of the bolt handle from the handle opening.

11. A method of assembling a bolt assembly for a firearm, comprising:

inserting a bolt handle into a handle opening defined by a bolt body, the bolt body having a bolt cavity defined between opposing sidewalls and a firing pin axis extending through said bolt cavity;

inserting a portion of a bolt shroud into said bolt cavity and through an aperture defined by a portion of said bolt handle positioned within said bolt cavity; and inserting a clip into said bolt cavity;

wherein said clip defines a clip aperture that receives said bolt shroud, and wherein said clip resists removal of the bolt shroud from the bolt cavity; and wherein said bolt shroud resists removal of the bolt handle from the handle opening of the bolt body.

12. The method of claim 11, wherein said clip resists removal of the bolt shroud from the bolt cavity by a forward facing surface of said clip contacting a rearward facing surface of the bolt shroud.

13. The method of claim 12, wherein the rearward facing surface of the bolt shroud does not contact the bolt handle.

14. The method of claim 11, wherein when inserting the bolt handle into the handle opening a distal end of the bolt handle passes through a first sidewall of said opposing sidewalls, through said bolt cavity, and into a second sidewall of said opposing sidewalls.

15. The method of claim 11, wherein said clip and said bolt shroud are configured to resist withdrawal of the clip from the bolt shroud.

16. The method of claim 15, wherein said bolt shroud includes a bolt shroud tang, wherein said bolt shroud tang includes a tang body having a cross-sectional dimension and a tang notch having a cross-sectional dimension each measured transverse to the firing pin axis when the bolt shroud tang is inserted into the bolt cavity, and wherein the cross-sectional dimension of said tang notch is less than said cross-sectional dimension of said tang body.

17. The method of claim 16, wherein said inserting a portion of said bolt shroud into said bolt cavity includes aligning said tang notch with said handle opening.

18. The method of claim 16, wherein the tang notch is positioned in the clip aperture after inserting said clip into the bolt cavity.

19. The method of claim 16, wherein inserting the clip includes inserting the clip into the handle opening.

20. The method of claim 16, wherein said clip is inserted into said bolt cavity after said bolt shroud is inserted into said bolt cavity.

* * * * *